US005588565A

United States Patent [19]

Miller

[11] Patent Number: 5,588,565

[45] Date of Patent: Dec. 31, 1996

[54] VALVE FOR DISPENSING PRESSURIZED FLUID THROUGH A FLEXIBLE TUBE

[76] Inventor: Sidney H. Miller, 850 E. Louther St., Carlisle, Pa. 17013

[21] Appl. No.: 195,645

[22] Filed: Feb. 14, 1994

[51] Int. Cl.[6] ..... B65D 83/00

[52] U.S. Cl. ..... 222/394; 222/402.13; 222/464.1; 222/517

[58] Field of Search ..... 222/394, 402.1, 222/402.13, 464, 511, 517

[56] References Cited

U.S. PATENT DOCUMENTS 3,998,364 12/1976 Hollander ..... 222/394 X

FOREIGN PATENT DOCUMENTS 254619 1/1963 Australia ..... 222/394

*Primary Examiner*—Andres Kashnikow
*Assistant Examiner*—Joseph A. Kaufman

[57] ABSTRACT

The invention relates to a dispensing valve for emptying pressurized fluid from a container. A clamping device or pinching projections open and close a passage through a flexible dispensing tube. Various types of lever and cap arrangements are employed to actuate the pinching or clamping structures. A seal around the dispensing tube prevents the fluid from escaping through the cap of the container.

7 Claims, 2 Drawing Sheets

VALVE FOR DISPENSING PRESSURIZED FLUID THROUGH A FLEXIBLE TUBE

BACKGROUND OF THE INVENTION

Many bottles are described in the patent files. U.S. Pat. No. 4,671,436, dated Jun. 9, 1987 was used as a commercial product and could be found in many supermarkets. U.S. Pat. No. 4,671,436, patented by inventor Richard J. Hagen, is composed of many parts. In the design we are proposing, we have reduced the number of pieces to a total of 3 or 4. Our new design will now make it possible to have a throw-away dispenser valve on all bottles that contain carbon dioxide or other propellants.

SUMMARY OF THE INVENTION

In this invention, a tube extends from inside a bottle to the outside and is open and closed by depressing and releasing a cap or handle that opens and closes a set of pincers or claws that surround a tube.

FIELD OF INVENTION

This invention describes a very economical system for dispensing liquids from bottles.

DESCRIPTION OF THE DRAWINGS a. FIG. 1 shows a sectional view of the bottle dispenser with a trigger type of handle.

b. FIG. 2 shows a sectional view of the bottle dispenser.

c. FIG. 3 shows the bottle dispenser without bands or springs.

d. FIG. 4 shows the bottle dispenser in a sectional view with a cap type actuator.

e. FIG. 5 is a sectional view of the bottle dispenser with the clamp type pinchers and associated band.

f. FIG. 6 is a sectional view of the bottle dispenser with a clamp type and actuation with a leaf or ring type spring.

g. FIG. 7 is the dispenser without the bottle.

DETAILED DESCRIPTION OF THE DRAWINGS

Figure 2:
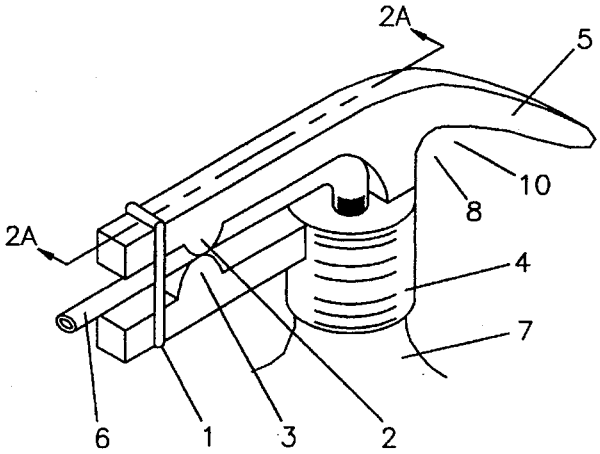
Figure 1:
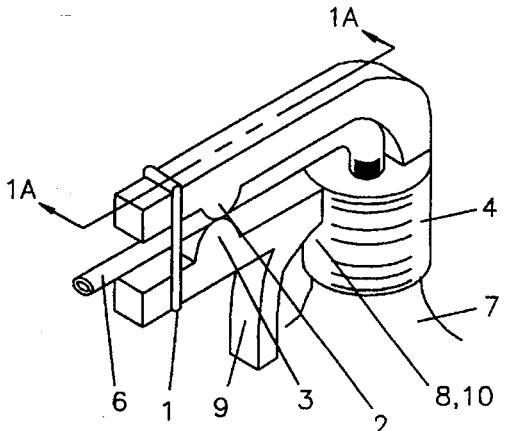
Figure 4:
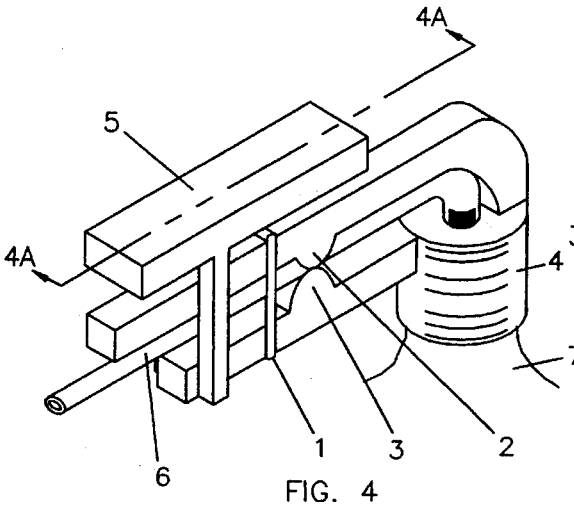
Figure 3:
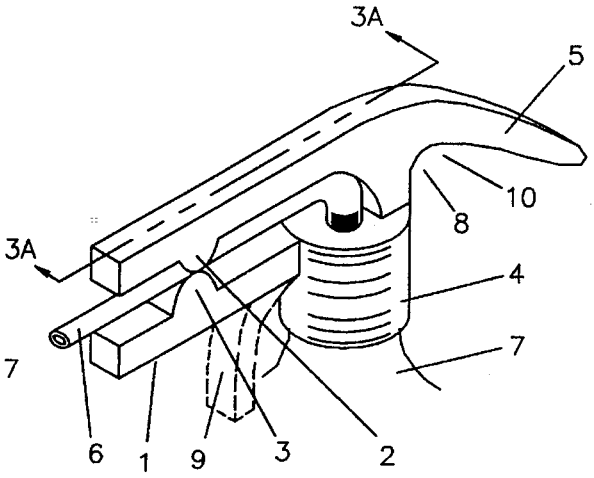
Figure 6:
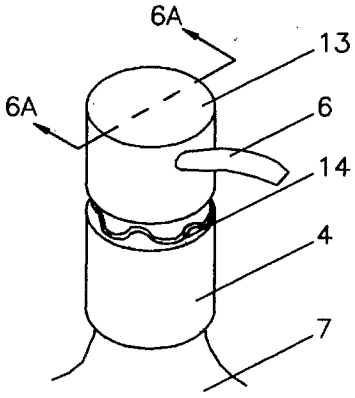
Figure 5:
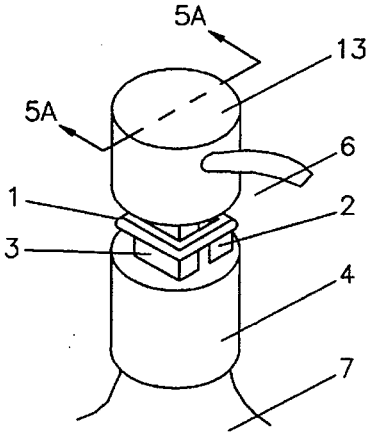
Figure 7:
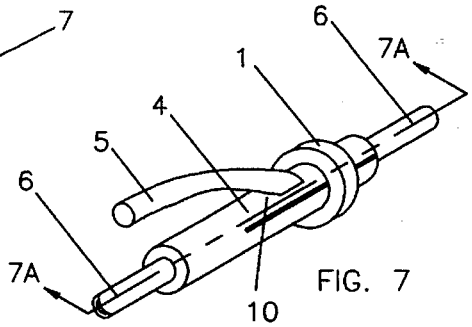
Figure 2A:
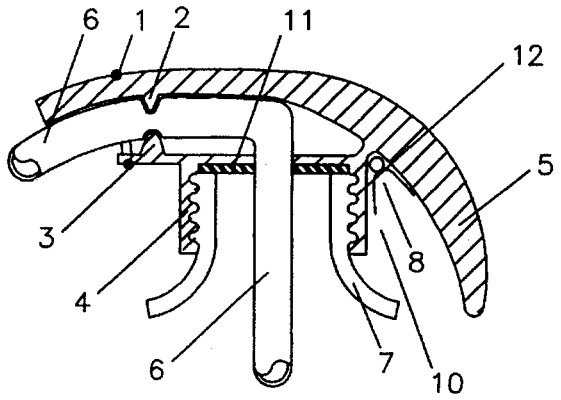
Figure 1A:
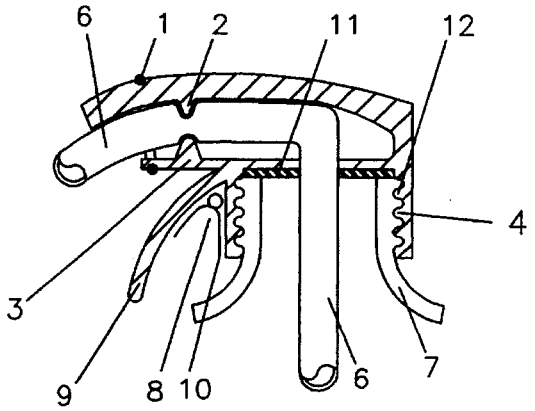
Figure 4A:
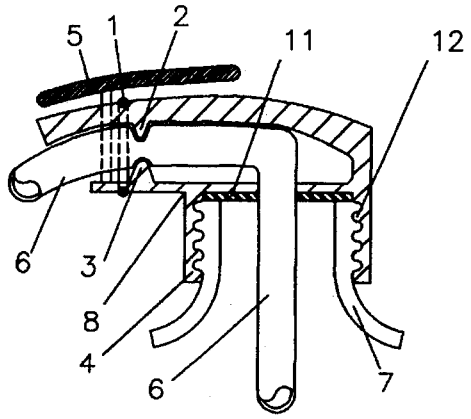
Figure 3A:
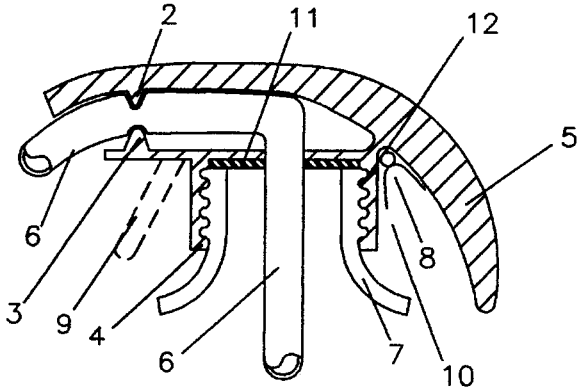
Figure 6A:
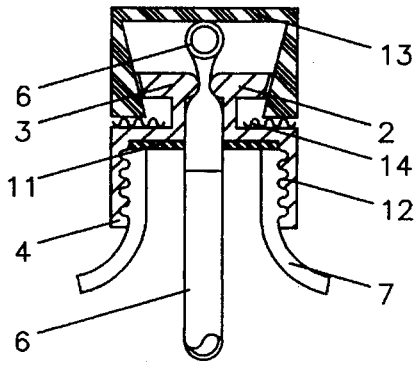
Figure 5A:
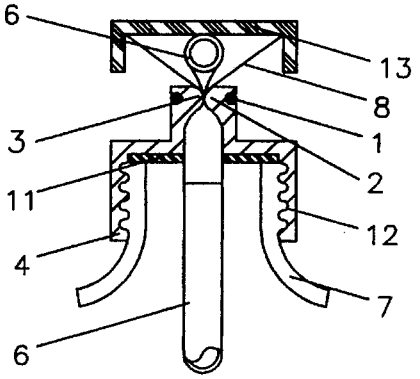
Figure 7A:
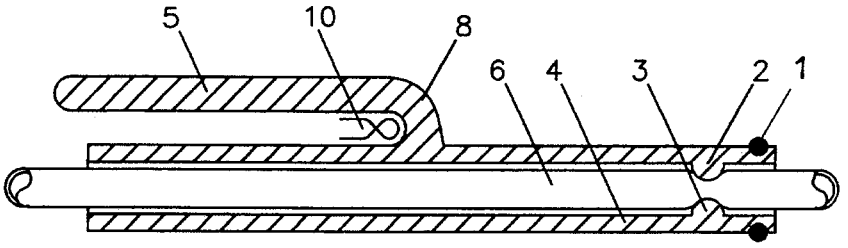

FIG. 1 shows a dispensing valve attached to a container 7. A flexible dispensing tube 6 has one end extending into the container and a discharge end extending through the valve and out of the container. The dispensing tube is seated inside a cap 4 that attaches to the neck of container 7. The discharge tube 6 is surrounded by a disk 11; the disk being located between the cap 4 and the top lip of the neck of the container 7. The disk seals the container when pressure from a pressurized fluid located within container 7 forces the discharge tube 6 to radially expand against the disk 11. The cap 4 includes a lever 16 the cap and lever forming a channel for the dispensing tube to pass therethrough. Projections 2 and 3 are located on the lever 16 and cap 4, respectively, and together comprise a pinching means. The projections 2 and 3 are located within the channel for regulating flow through the dispensing tube 6. A resilient biasing means 1 surrounds the lever and the cap to bias the pinching means to a normally closed position, preventing fluid flow out of the container. A trigger 9 is attached to the cap 4 by hinge 8. Squeezing the trigger 9 towards the container 7 forces the cap 4 away from lever 16, thereby disengaging the pinching means from the dispensing tube 6 and permitting the pressurized fluid to be dispensed. When the trigger 9 is released, a spring 10 forces the trigger 9 away from the container 7, thereby closing the pinching means and stopping the flow of fluid out of the container 7. Spring 10 is optional as the natural resiliency of the trigger 9 would normally be sufficient to close the valve. The embodiment of FIG. 2 is similar to the embodiment of FIG. 1 but shows a handle 5 attached to lever 16. Squeezing the handle 5 towards the container biases the lever 16 and cap 4 apart, permitting flow of a pressurized fluid out of the container. Alternatively, the handle can be held in place by springs that are mounted in the area of hinge 8. FIG. 3 shows a third embodiment of the invention. Here, the resiliency of the plastic biases the lever 16 and cap 4 together without the need for a resilient biasing means. The handle 5 may be replaced by the trigger 9 as shown in phantom lines in the figure. In FIG. 4, the dispensing tube is opened by depressing the depressing cap 51. Depressing cap 51 is attached to cap 4 as seen by the phantom lines in the figure. When depressing cap 51 is pressed, the connection forces lever 16 and cap 4 apart, thereby allowing fluid to flow out through dispensing tube 6. When depressing cap 51 is released, resilient biasing means 1 forces the pinching means together and terminates flow out of the tube. In the embodiment of FIG. 5, claws 22 and 32 engage dispensing tube 6 to open and close the valve. Teeth 8 attached to cap 13 engage claws 21 and 31. When cap 13 is depressed, teeth 8 force claws 21 and 31 apart, thereby allowing the fluid to flow out of the container. When the cap 13 is released, biasing means in the form of O-ring 101 closes the pinching means and stops the flow of fluid out of the valve. FIG. 6 shows a cap 131 that engages claws 22 and 32. When cap 131 is depressed, spring 14 is depressed and forces claws 22 and 32 apart, thereby allowing fluid to flow out of the dispenser. When the cap is released, springs 14 bias the claws 22 and 32 closed. Finally, the embodiment of FIG. 7 shows a beverage dispenser not attached to a bottle. Handle 52, when depressed, biases lever 161 away from base 41 thereby moving projections 23 and 33 away from each other. This allows fluid to flow out of the tube 6. Resilient biasing means 1 closes the pinching means when the pressure on handle 52 is released. The resilient biasing means may comprise a resilient band or spring.

I claim the following:

1. A dispensing valve comprising a flexible dispensing tube, the dispensing tube having one end inside of a container and a discharge end outside of the container; a disk attached to the dispensing tube for positioning the tube within the container, said disk being held between a cap and a container top lip; a seal being formed between the disk and the dispensing tube when the dispensing tube expands radially from pressure from a pressurized fluid contained within the container; the dispensing valve further comprising a lever attached to said cap, the lever and the cap having cooperating pinching means for regulating the flow of the pressurized fluid out of the container; and a resilient band encircling the lever and the cap proximal to the dispensing end of the dispensing tube for biasing the lever towards the cap in order to permit discharge of the pressurized fluid only when the lever is actuated.

2. The dispensing valve according to claim 1 further comprising a depressing means located above the lever and cap for biasing the lever away from the cap, thereby disengaging the pinching means from the dispensing tube.

3. The dispensing valve according to claim 1 further comprising a trigger attached to a bottom of said cap for biasing the lever away from the cap, thereby disengaging the pinching means from the dispensing tube.

4. The dispensing valve according to claim 3 further comprising a hinge and a spring located between the trigger and the cap for assisting in biasing the pinching means to a normally closed position.

5. A dispensing valve comprising a flexible dispensing tube, the flexible tube having one end inside of a container and a discharge end outside of the container; a disk attached to the dispensing tube for positioning the tube within the container, said disk being held between a cap and a container top lip; the dispensing valve further comprising a pair of claws located near the dispensing end of the dispensing tube, the claws being biased together by at least one biasing means in order to prevent flow of material through the tube while the claws are biased together; and depression of the cap forcing the claws apart, thereby permitting a pressurized fluid within the container to be dispensed.

6. The dispensing valve of claim 5 wherein the at least one biasing means comprises springs.

7. The dispensing valve of claim 5 wherein the at least one biasing means comprises at least one O-ring.

* * * * *